US005363600A

United States Patent [19]

Shishido et al.

[11] Patent Number: 5,363,600

[45] Date of Patent: Nov. 15, 1994

[54] DUST SCATTERING PREVENTION DEVICE IN FLOOR POLISHER

[75] Inventors: Osamu Shishido; Satoshi Arai; Yuugo Tomaru; Eiji Nagayama, all of Shizuoka, Japan

[73] Assignee: Amano Corporation, Kanagawa, Japan

[21] Appl. No.: 966,836

[22] Filed: Oct. 27, 1992

[30] Foreign Application Priority Data

Oct. 31, 1991 [JP] Japan ..... 3-098028[U]

[51] Int. Cl.[5] ..... B24B 23/02

[52] U.S. Cl. ..... 451/397; 451/358; 451/456

[58] Field of Search ..... 51/177, 170 R, 174, 51/170 T, 273, 268

[56] References Cited

U.S. PATENT DOCUMENTS

| | | | |
|---|---|---|---|
| 1,581,855 | 4/1926 | May | 51/177 |
| 1,627,263 | 5/1927 | Baily | 51/177 |
| 2,301,164 | 11/1942 | Mall | 51/177 |
| 4,731,895 | 3/1988 | Zack et al. | 15/98 |
| 4,731,956 | 3/1988 | Wood | 51/177 |
| 4,742,652 | 5/1988 | Cannan et al. | 51/177 |
| 4,939,811 | 7/1990 | Matunaga et al. | 15/385 |

FOREIGN PATENT DOCUMENTS

| | | | |
|---|---|---|---|
| 1286825 | 1/1962 | France | 51/177 |
| 0079818 | 12/1962 | France | 51/177 |
| 2232367 | 12/1990 | United Kingdom | 51/177 |

*Primary Examiner*—Roscoe V. Parker

*Attorney, Agent, or Firm*—Stevens, Davis, Miller & Mosher

[57] ABSTRACT

In a floor polisher for polishing a floor by rotating a pad by a motor while running the floor polisher by way of pushing an operation handle, a dust scattering prevention device in the floor polisher comprising a dust scattering prevention cover which is provided at least a lower end portion thereof with a ring-shaped core bar and the whole of which is formed into a generally skirt-like shape widened toward a lower end thereof, using a flexible cloth, the cover being attached to a lower end opening of a pad covering an upper surface side of the pad in such a manner as that a lower end portion of the cover is in contact with the floor.

3 Claims, 2 Drawing Sheets

DUST SCATTERING PREVENTION DEVICE IN FLOOR POLISHER

BACKGROUND OF THE INVENTION

1. Field of the Invention

This invention is utilized in the technical floor polisher, in which the operator pushes an operation handle by hand in order to run the polisher, and in the meantime, a pad is rotated at a high speed by a motor. More specifically, it relates to a dust scattering prevention device on a floor polisher which is deliberately designed such that scattering of dust around the polisher caused by high speed rotation of the pad can be prevented.

2. Brief Description of the Prior Art

As discussed in, for example, U.S. Pat. Nos. 4,731,895 or 4,939,811, the conventional hand-push type floor polisher which in operation is pushed by a worker for polishing the floor, has a pad which is covered at an upper surface side thereof with a pad cover and rotated at a high speed by a motor, and a skirt-like stationary cover or a rubber cover attached to a lower end opening of this pad cover in order to seal tight the interior of the cover, so that scattering of dust caused by high rotation of the pad and leakage of noise can be prevented.

However, these stationary and rubber covers are not sufficient in design to follow the contour of the floor. If there are irregularities, steps, etc. on the floor, the lower end opening of the cover is turned up to form a space between the cover and the floor. Therefore, from this space dust is scattered outside and noise is leaked outside. In the case of a floor polisher in which the surrounding of the pad is sealed to generate a negative pressure at the bottom and surrounding area of the pad by high speed rotation of the pad so that the pad surface is in intimate contact with the floor by this negative load absorption, the pressurized air flow generated by the rotation of the pad escapes from the space formed between the floor and the cover and the negative pressure is not sufficient to maintain contact of the pad with the floor.

The present invention has been accomplished to overcome the above situation.

SUMMARY OF THE INVENTION

It is therefore an object of the present invention to provide a dust scattering prevention device on a floor polisher, in which intimacy and the ability of the cover to follow the contour of the floor are increased so that dust and noise will not leak outside while the pad is rotating at a high speed.

Another object of the present invention is to provide a dust scattering prevention device in a floor polisher, in which loss of negative pressure within a pad cover can be minimized.

To achieve the above object, there is essentially provided, in a floor polisher for polishing a floor by rotating a pad by a motor while running said floor polisher by way of pushing an operation handle, a dust scattering prevention device in said floor polisher comprising:

(1) a dust scattering prevention cover which is provided at least a lower end portion thereof with a ring-shaped core bar and the whole of which is formed into a generally skirt-like shape widened toward a lower end thereof, using a flexible cloth, (2) said cover being attached to a lower end opening of a pad cover covering an upper surface side of said pad in such a manner as that a lower end portion of said cover is in contact with the floor.

The dust scattering prevention device in a floor polisher according to the present invention exhibits the following function.

(1) With respect to the feature of the above (1), since the core bar is inserted into the lower end portion of the dust scattering prevention cover, the lower end opening of the cover is always maintained in a ring shape (complete round) and the lower end portion is not twisted nor turned up nor deformed, and in addition it is not suffered from a deformation habit (i.e., once it is deformed in a certain shape, it tends to take that shape frequently). Since intimacy and the ability of the cover to follow the contour of the floor can always be obtained, stability can be increased, and dust and noise are not scattered nor leaked outside. In addition, negative pressure within the pad cover can be prevented from being lowered in order to enhance intimacy of the pad surface with the floor.

(2) With respect to the feature of the above (2), by virtue of the anti-wear property and slidability of sleeve covering the lower portion, the service life of the dust scattering prevention cover can be prolonged and the cover is not turned up nor caught which otherwise occurs due to resistance when the floor polisher is moved. As a consequence, intimacy and the ability of the cover to follow the contour of the floor are much improved.

The above and other objects and further features of the present invention will become more manifest to those skilled in the art upon a reading of the detailed description of the embodiment in connection with the accompanying drawings.

DETAILED DESCRIPTION OF THE PREFERRED EMBODIMENT

One preferred embodiment of a dust scattering prevention device in a floor polisher according to the present invention will now be described in detail with reference to the accompanying drawings.

Figure 1:
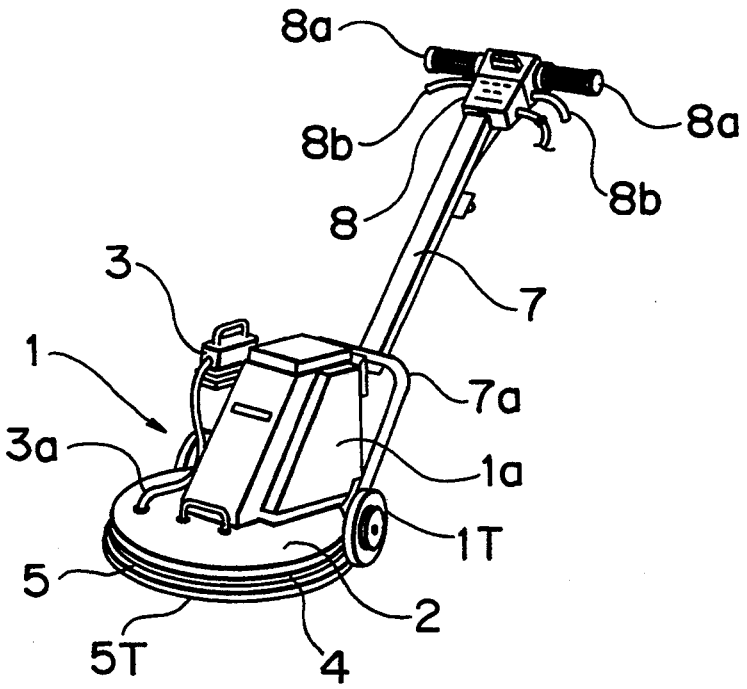
FIG. 1 is a perspective view of a dust scattering prevention device in a floor polisher including a dust scattering prevention device according to the present invention.

FIG. 1 is a perspective view showing a whole construction of a floor polisher incorporated with a dust scattering prevention device of the present invention. In FIG. 1, the numeral 1 denotes a floor polisher, 1T, wheels, 1*a*, an outer cover with a motor (not shown) contained therein, and 2, a pad cover mounted, on the bottom of a front portion of the outer cover 1*a*, respectively. Within this cover 2, a floor polishing pad 6 (see FIG. 3) is stored rotatable at a high speed by the motor.

Again in FIG. 1, the numeral 3 denotes a tank for supplying a spay liquid, etc. to the pad 6 through a hose 3*a*. Numeral 7 denotes an operation handle mounted on a rear portion of the floor polisher with bracket 7*a*. Numeral 8 is an operation box mounted on an upper end of this operation handle 7. Numerals 8*a*, 8*a'* are a pair of handle bars, and 8*b*, 8*b'*are a pair of operation levers, respectively.

Figure 2:
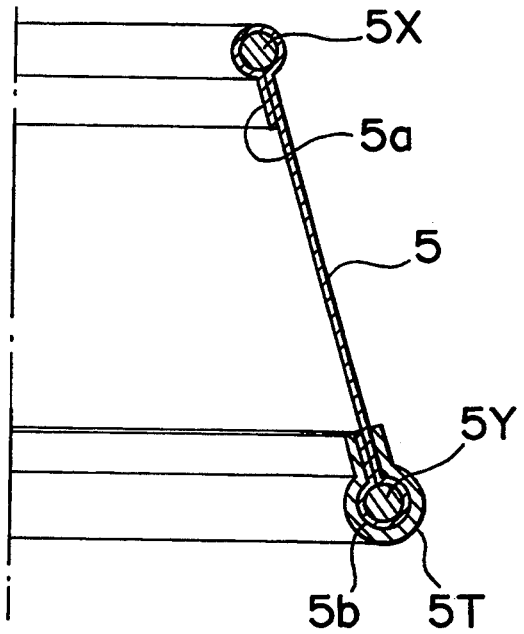
FIG. 2 is a sectional view showing a part of a dust scattering prevention cover used in the present invention.

In FIG. 2, the numeral 5 denotes a dust scattering prevention cover formed in a generally skirt-like shape widened toward a lower end thereof as a whole, using a flexible cloth such as, for example, nylon fiber coated with rubber. This dust scattering prevention cover is provided at both upper and lower end portions thereof with core bars 5X and 5Y which are formed into a ring-shape as a whole. The core bars 5X and 5Y are wrapped and sewn within upper and lower end pieces 5*a* and 5*b*. The entirety of the dust scattering prevention cover 5 thus constructed is removably attached, as shown in FIG. 3, to the edge of the lower end opening 2*a* of the pad cover 2 in such a manner as to surround the pad 6, using a ring-like clamp 4 having a generally C-shape at its upper portion where the core bar 5 is attached to the lower end opening 2*a* of the pad cover 2.

Figure 3:
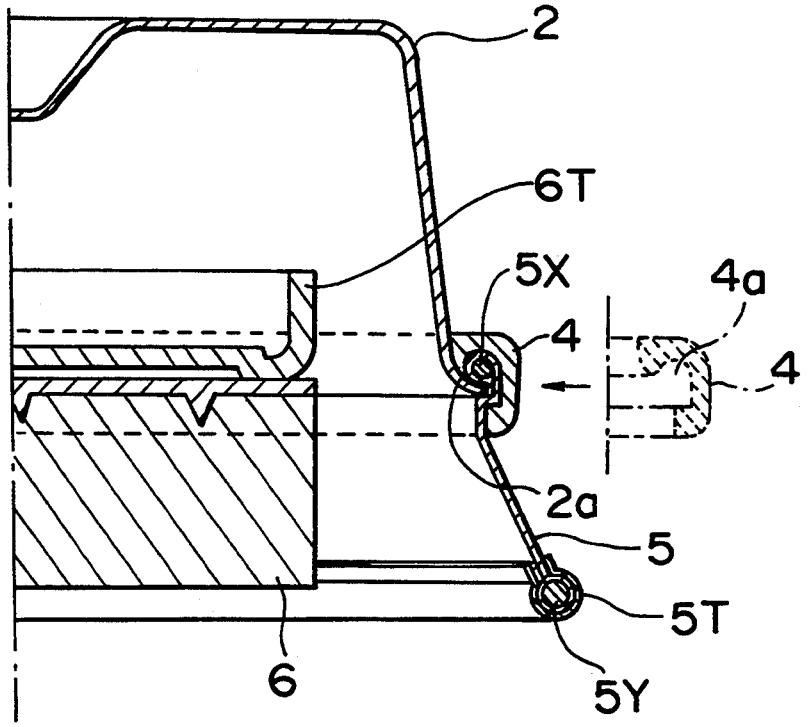
FIG. 3 is a sectional view showing a part of a pad cover portion incorporated with the present invention.

In FIG. 3, 4*a* denotes a presser groove formed in the inner side of the clamp 4, and the dust scattering prevention cover 5 is tightly attached to the edge of the lower end opening 2*a* of the pad cover 2 by resiliency of the clamp 4 with the upper core bar 5X portion received in this presser groove 4*a*. For exchanging, this cover 5 can be easily removed from the pad cover 2 by releasing the clamp 4 against its resiliency. In FIG. 3, 6T denotes a mounting board for the pad 6. A rotary shaft (not shown) rotated by a motor is attached to this mounting board 6T.

5T denotes a sleeve attached to the lower end portion of the dust scattering prevention cover 5 in such a manner as to enwrap the core bar 5Y. This sleeve 5T is formed of a material having an anti-wear property and slidability such as a thick nylon material. This sleeve 5T sewn to the lower end portion of the cover 5 in such a manner as to double cover the core bar 5Y together with the lower end element 5*b* of the cover 5. As a result, wear of the lower end portion of the dust scattering prevention cover 5 can be prevented and slidability is increased.

As the dust scattering prevention device in a floor polisher according to the present invention is constructed in the manner as described above, when the dust scattering prevention cover 5 is attached to the edge of the lower end opening 2*a* of the pad cover 2 using the ring-like clamp 4 as shown in FIGS. 1 and 3, this cover 5 covers the periphery of the pad 6 with its lower end portion in contact with the floor. As a result, scattering of dust and leakage of noise caused by high speed rotation of the pad 6 can be prevented. In addition, lowering of the negative pressure generated to the bottom and the surrounding of the pad 6 can be prevented.

Since the dust scattering prevention cover 5 is formed in a generally skirt-like shape widened toward a lower end thereof as a whole, using a flexible cloth such as, for example, nylon fiber coated with rubber, and provided at its lower end with the ring-like core bar 5Y, the dust scattering prevention cover 5 can be maintained, as a whole, in a complete round state surrounding the pad 6 and the lower end portion is intimately contacted with the floor to exhibit its excellent intimacy and the ability to follow the contour of the floor. As a result, even if the floor has irregularities and steps, the dust scattering prevention cover 5 is not deformed nor turned up to form a space between the floor and itself.

Furthermore, the sleeve 5T covering the lower end portion of the dust scattering prevention cover 5 prevents not only wear of the cover 5 but also deformation of the cover 5 by exhibiting an excellent slidability. As a result, intimacy and followability with the floor can be further increased.

As apparent from the foregoing description, according to a dust scattering prevention device in a floor polisher of the present invention, scattering of dust and leakage of noise caused by high speed rotation of the pad can be prevented and lowering of negative as well as deformation and turning-up of the dust scattering prevention cover can be prevented. As a result, the floor can be polished quietly without scattering dust outside and efficiently with the pad intimately contacted with the floor. Particularly, since the floor polisher of the present invention exhibits high ability to follow the contour of the floor, it can be suitably used for polishing a floor having irregularities and steps.

Although one preferred embodiment of the present invention has been described in detail, the invention is not limited to this embodiment. Various changes and modifications can be made without departing from the spirit of the present invention.

What is claimed is:

1. In a floor polisher for polishing a floor by rotating a pad with an upper side surface pad cover by a motor while running said floor polishing by way of pushing an operational handle, the improvement comprising a dust scattering prevention device attached to said floor polisher, said dust scattering prevention device comprising a dust scattering prevention cover formed from a flexible, cloth into a generally skirt-like shape widening toward a lower end portion thereof and having at least a lower end portion thereof covering a ring-shaped core bar, said dust scattering prevention cover being attached to a lower end opening of said upper side surface pad cover in such a manner that said lower end portion of said cover contacts the floor.

2. The dust scattering prevention device on a floor polisher as claimed in claim 1, wherein said lower end portion of said dust scattering prevention cover covering said ring-shaped core bar has a sleeve attached thereto formed of material having anti-wear floor-sliding properties.

3. The dust scattering prevention device on a floor polisher as claimed in claim 1, including a ring-shaped core bar covered by an upper end portion of said dust scattering prevention cover and a ring-like clamp, said ring-like clamp having a generally C-shaped and clamping a lower edge of said pad cover to said ring-shaped core bar covered by said upper end portion of said dust scattering prevention cover.

* * * * *